United States Patent [19]

Derni et al.

[11] Patent Number: 4,860,914

[45] Date of Patent: Aug. 29, 1989

[54] COLLAPSIBLE SWIMMING POOL

[76] Inventors: Roxanne M. Derni; Nicodeme B. Derni, both of 450 N. Prospect Dr., Brookfield, Wis. 53005

[21] Appl. No.: 186,038

[22] Filed: Apr. 25, 1988

[51] Int. Cl.[4] ..... B65D 8/00

[52] U.S. Cl. ..... 220/4 C; 4/506; 52/169.7; 220/5 A

[58] Field of Search ..... 4/488, 494, 495, 506, 4/584; 220/4 F, 5 A, 5 R, 6, 7, 4 R, 4 C, 83; 52/65, 67, 169.7; D21/252; D25/2

[56] References Cited

U.S. PATENT DOCUMENTS

D. 282,998 3/1986 Ransom ..... D7/23

FOREIGN PATENT DOCUMENTS 130442 5/1902 Fed. Rep. of Germany ..... 220/6
200721 7/1908 Fed. Rep. of Germany ..... 220/287
630351 5/1936 Fed. Rep. of Germany ..... 220/4 R

*Primary Examiner*—Henry J. Recla
*Assistant Examiner*—Glenn T. Barrett
*Attorney, Agent, or Firm*—James E. Nilles; Donald C. McGaughey

[57] ABSTRACT

A collapsible swimming pool is provided which comprises a plurality of nestable sections. Each section has a bottom wall with an inner portion and a side wall which is connected with the bottom wall to extend in a generally vertical direction when the pool is set up for use. A retainer is provided for securing the inner portions together. The side wall of each section has generally vertical leading and trailing edges. A first locking flange is provided on the leading edge and a second locking flange is provided on the trailing edge. The first locking flange on the side wall of one section is interlockable with the second looking flange on the side wall of a next adjacent section to releasably secure all the sections together when the pool is set up.

5 Claims, 6 Drawing Sheets

COLLAPSIBLE SWIMMING POOL

BACKGROUND OF THE INVENTION

1. Field of the Invention

This invention relates to a collapsible swimming pool and more specifically to a pool made up of a plurality of sections which can be easily set up and quickly interlocked with each other to form an integrated swimming pool, or collapsed and nested one on top of the other for the purpose of compact storage.

2. Discussion of the Prior Art

It has long been recognized in the prior art, especially in geographic areas having seasons that present cold and freezing weather, that it is desirable and in some circumstances necessary for swimming pools to be emptied of water and stored away until warm weather returns. The simplest type of prior art swimming pool is made in one piece, usually molded from plastic material. Such one-piece pools are relatively small but even the smallest children's size pools of this type must be up to six or eight feet in diameter and 12 to 18 inches in depth in order to effectively function as an enjoyable swimming pool. As such pools are not collapsible they present storage problems for the average pool owner. In addition, handling of such one-piece pools when storing frequently results in cracking and breaking of the plastic and often such pools become unusable after only a single season and must be replaced at some expense.

In an effort to overcome the storage problem presented by the one-piece molded pools, it has been suggested to make a one-piece pool out of flexible sheet material such as vinyl plastic and provide it with a tubular inflatable side wall or walls. While inflatable side wall pools can be collapsed, they are difficult to fold up and have the disadvantage of the tubular side walls being easily punctured. Further, inflatable side walls do not have sufficient strength in tension or in vertical compression to retain an appreciable depth of water and such pools are undesirably shallow and functionally unattractive to all but the smallest children.

In order to overcome the disadvantages, of the inflatable side wall pools, U.S. Pat. No. 1,961,061 issued May 29, 1934 to M. L. McCulloch teaches the use of a one-piece pool made of flexible material. The areas of this pool that join the side wall and base are reinforced by additional overlapping layers of material and the side walls themselves are also reinforced by additional thicknesses of material. In addition, it is suggested that ropes encircle the side walls for providing further reinforcement. The extreme upper edge is stiffened by wood inserts, A similar design for a one-piece pool is taught in U.S. Pat. No. 2,839,762 issued June 24, 1958 to R. Nomura. While pools of this general design will perform satisfactorily, the reinforcing used makes them bulky and difficult to collapse. In cooler weather, the material of which the pool is made stiffens and does not lend itself to easy folding into a compact unit for storage.

In response to the need for an improved collapsible swimming pool, U.S. Pat. No. 2,939,153 issued June 7, 1960 to C. R. Arnold et al teaches that the side wall of the pool be made of a plurality of rectangular frame sections. The pieces which make up the frame sections include a plurality of sockets which are used to secure the plurality of individual frame pieces together to form a cylindrical wall. A continuous metal reinforcing wall is installed inside the cylindrical wall and a waterproof liner is then added to complete the pool. A pool of this design includes a large number of parts and the complexity of the frame assembly does not permit quick easy assembly and disassembly. Further, the large number of frame members and the continuous reinforcing wall are not compact when collapsed and present storage problems. Further, such pools have a high number of individual pieces which increases the risk that one or more of the pieces may be lost.

Another type of collapsible swimming pool is taught in U.S. Pat. No. 2,861,277 issued Nov. 25, 1958 to L. Hermann. This patent teaches the use of a plurality of interlocking aluminum extrusions to form the side wall of the pool. The side wall extrusions do not include any bottom wall portions and are each provided with a slotted channel defining a cylindrical chamber on one vertical edge and a cylindrical bead on the other edge. The extrusions must be slid vertically downward over a smaller vertically extending cylindrical bead on an adjacent wall section. Channel-shaped members are added to enclose the upper edges of the extrusion. Such a pool also utilizes a large number of separate component parts which require time consuming assembly and disassembly, and compact storage is not easily achieved. Further, any distortion or bending of the extruded channel or bead from a straight line will make it very difficult, if not impossible, to assemble or disassemble the pool because of binding of the beads within their respective channels.

SUMMARY OF THE INVENTION

It is an object of the present invention to provide a swimming pool that overcomes the shortcomings of prior designs, is easily and quickly set up or collapsed, will afford a compact unitary assembly when collapsed for space saving storage without risk of losing any component parts, is economical in cost to manufacture, and is rugged and durable in use.

The present invention provides a swimming pool which is made up of a plurality of nestable sections. Each section includes a horizontal bottom wall and generally vertical side wall when placed in a normal setup position to form a pool. The bottom wall of each section has an inner portion. A retainer means is provided for releasably securing the bottom wall inner portions together to prevent radially outward movement thereof when the pool is filled with water. The releasable retainer means may comprise either a lost motion aperture in the inner portion of each section through which a pivot member is inserted or a hook and ring assembly. If the lost motion aperture and pivot member retainer means are used, the inner wall portions will be in overlapping relation, one on top the other, with the lost motion apertures aligned to define a pivot member receiving bore. The pivot member is mounted in the bore to loosely secure the inner portions together to permit simultaneous radial and pivotal movement of each section relative to the other sections. The radial and circumferential movements allow the sections to be rotated fan-like about the pivot member between a collapsed closed position in which the sections are nested one on top of the other for storage, and a setup open position in which the bottom walls coact one with another to form a circular swimming pool bottom and the side walls coact one with another to form a continuous circular side wall. Each side wall has a generally vertical leading and trailing edge. A first locking means is provided on the leading edge and a second locking means is provided on the trailing edge. The first locking means on one side wall section being releasably interlocked with the second locking means of an adjacent side wall to secure the individual side walls into an integrated circular side wall.

Preferably, the lost motion aperture comprises an elongated slot which extends radially outward from the apex of the bottom wall. The pivot member is circular in cross section and has a diameter which will permit the pivot member to only move longitudinally in the elongated slot. The longitudinal extent of the slot is greater than the diameter of the pivot member plus the combined thickness of the total number of side walls that comprise the swimming pool.

If the retainer means comprises a hook and ring means, preferably each inner portion of a section will be provided with a hook which is inserted into a retainer ring.

Preferably, the first locking means comprises a first flange portion that extends circumferentially away from the leading edge of the side wall and a first latch portion which folds back to extend circumferentially toward the leading edge of the side wall in spaced parallel relation to the outer surface of the side wall to form therebetween a first latch receiving gap. Similarly, the second locking means comprises a second flange that has a second flange portion extending circumferentially away from the trailing edge of the side wall and a second latch portion which folds back to extend circumferentially toward the trailing edge of the side wall in spaced parallel relation to the inner surface of the side wall to form therebetween a second latch receiving gap. The first flange latch portion is dimensioned to interlock in the second latch receiving gap and the second flange latch portion is dimensioned to interlock in the first latch receiving gap when the pool is in a setup position to prevent circumferential movement of the side walls relative to one another. The first latch portion has a first interior surface and the second latch portion has a second interior surface. The first and second interior surfaces lie in circumferential alignment with the outer surface of the side wall.

It is also desirable that the bottom wall of each section includes leading and trailing margins which extend radialy outward from the apex portion and intersect the leading and trailing edges of the associated side wall. In one embodiment, the first and second locking means flange members extend circumferentially away from each other beyond the leading and trailing edges of the side wall and beyond the leading and trailing margins of the bottom wall.

In a second embodiment, first and second latch portions extend circumferentially inward toward each other and the leading and trailing margins of the bottom wall are provided with first and second slots, respectively. The first and second slots are in the bottom wall adjacent where the bottom wall margins intersect the side wall leading and trailing edges. The first and second slots extend circumferentially inward of the bottom wall toward each other.

Preferably, in the second embodiment, the first locking means includes a first latch portion which is in spaced parallel relation to the side wall outside surface and extends parallel to the first slot for a distance which is no greater than the circumferential depth of the first slot. Similarly, the second locking means includes a second latch portion which is in spaced parallel relation to the inner surface of the side wall and extends parallel to the second slot for a distance which is no greater than the circumferential depth of the second slot.

In the third embodiment of the invention only the trailing margin of the bottom wall is provided with a single slot. The second locking means includes a second latch portion which extends parallel to the single slot for a distance which is no greater than one-half of the circumferential depth of the slot.

The present invention also provides a nestable section for use in cooperation with a plurality of such sections to form a collapsible swimming pool. Each section preferably comprises a bottom wall having an apex portion with a lost motion aperture therethrough and a side wall connected to the bottom wall. The side wall has generally vertical leading and trailing edges when the section is set up in a position to form a pool. The side wall has a first locking means provided on the leading edge thereof and a second locking means provided on the trailing edge thereof. With respect to each section, the first locking means on the side wall of one section is releasably interlockable with the second locking means on the side wall of an adjacent section when a plurality of the sections are in a setup position to form a swimming pool.

DESCRIPTION OF THE PREFERRED EMBODIMENTS

Figure 1:
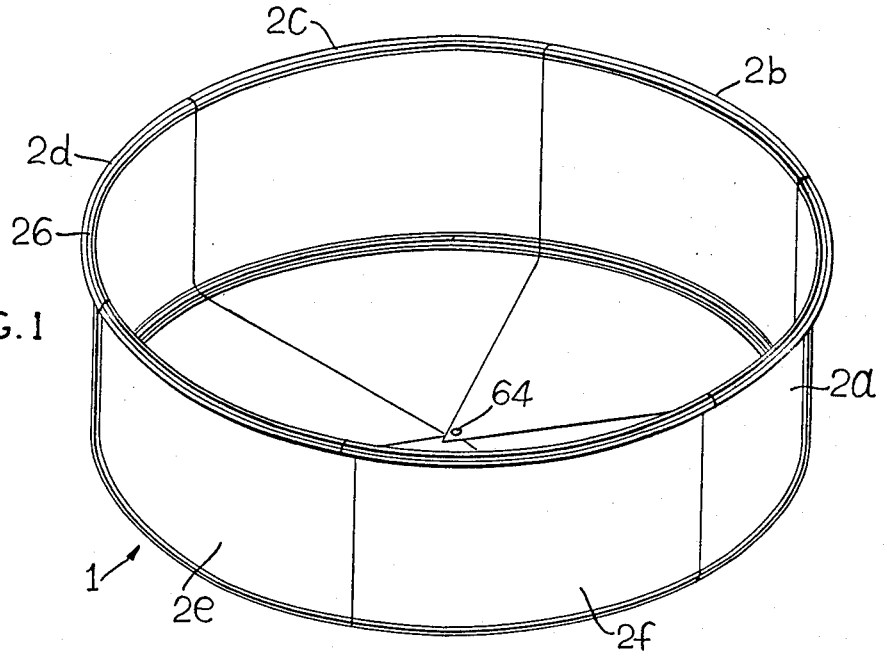
FIG. 1 is an isometric view showing the collapsible swimming pool in a setup position.
Figure 2:
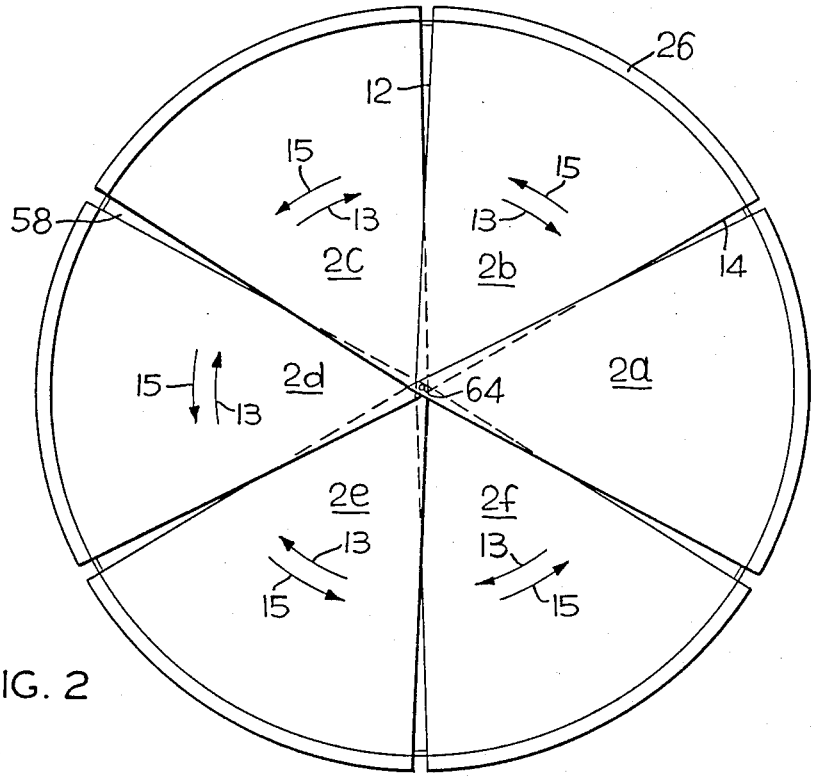
FIG. 2 is a top view of the pool shown in FIG. 1.

Referring to FIGS. 1, 2, 3 and 4, the swimming pool 1 is formed by a plurality of wedge-shaped sections 2 formed out of a semi-rigid material such as plastic. As shown, the pool comprises six sections *2a, 2b, 2c, 2d, 2e* and *2f* but a lesser or a greater number of sections could be used. Preferably, the sections are all identical but the sections could differ in design. Each section 2 includes a bottom wall 4 and a side wall 6 which is integrally connected to the bottom wall. The bottom wall is horizontally disposed and the side wall is generally vertically disposed when the pool is in a normal setup position. As shown, the side wall 6 extends vertically at a right angle to the bottom wall 4. However, the side wall 6 could incline inwardly or outwardly to any desired degree relative to bottom wall 4 without departing from the inventive concept, provided that the side walls have an overall vertical extent that will provide whatever depth is desired for the pool.

The bottom wall 4 is in the form of a wedge-shaped sector having an outer periphery and an inner portion 8 which may be in the form of an apex. The inner portions 8 are releasably secured by a suitable retaining means 10 (FIGS. 8, 9) or 210 (FIGS. 15, 16) when the swimming pool is in a setup position to prevent radially outward movement of the sections 2 relative to each other when the pool is filled with water. While two different retainer means 10 and 210 for releasably securing the inner portions 8 are disclosed and will now be described, other equivalent means will be apparent to those skilled in the art.

Figure 8:
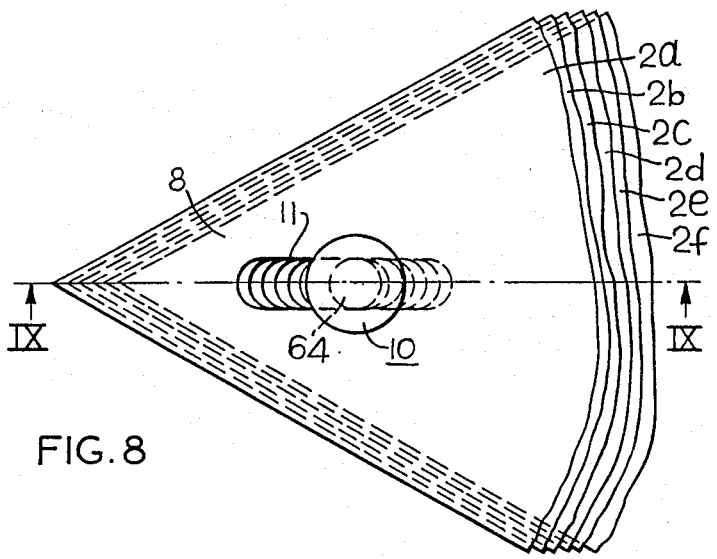
FIG. 8 is an enlarged partial top view of the apex portion shown in FIG. 7 with each section related to the other section when said pool is in a collapsed position.
Figure 9:
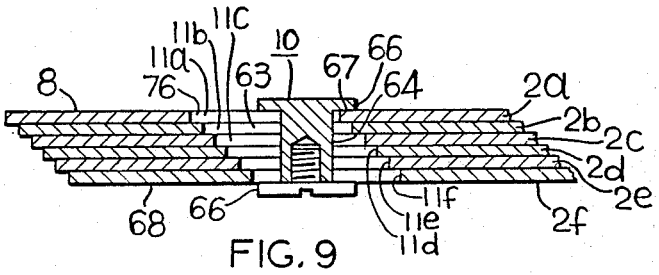
FIG. 9 is a sectional view taken along lines IX—IX of FIG. 8.
Figure 7:
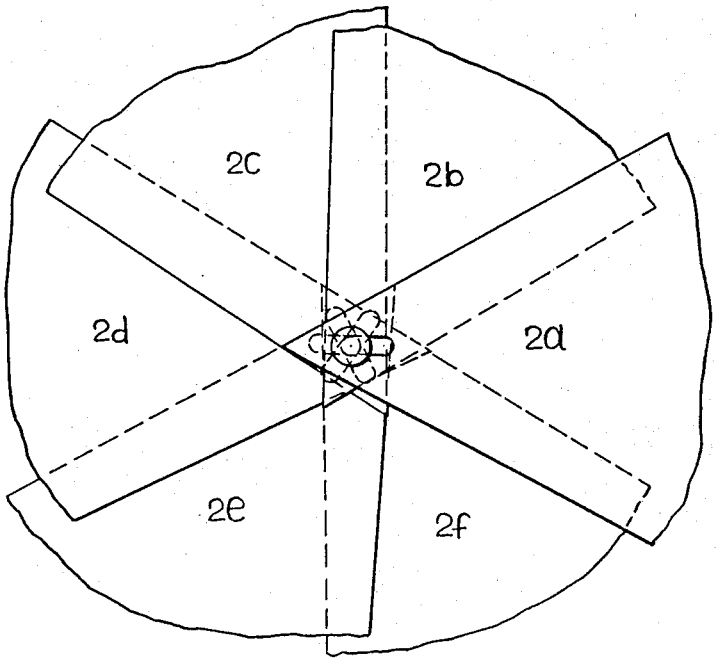
FIG. 7 is an enlarged partial top view of the center portion of the pool shown in FIG. 1 showing the position of the apex portion of each section relative to the other sections when the pool is in a setup position.

The first retainer means 10 for releasably securing the inner portions 8 together is best shown in FIGS. 8 and 9 and includes a lost motion aperture 11 in the form of an elongated slot which extends through the inner portion of each bottom wall and a pivot member 64. When using the first retainer means 10, the inner portions 8 overlap each other as shown in FIG. 9 and apertures 11 are in secured alignment to define a pivot member receiving bore 63. The pivot member 64 is inserted in the bore 63 to prevent radially outward movement of the sections 2 relative to each other when the pool is set up, as will be further explained hereinafter. When the first retainer means 10 is used, the inner portions 8 overlap and thus the inner portions 8 could be as wide as desired and need not be narrow or pointed, in which case the bottom wall of each section will not be precisely wedge shaped.

Figure 15:
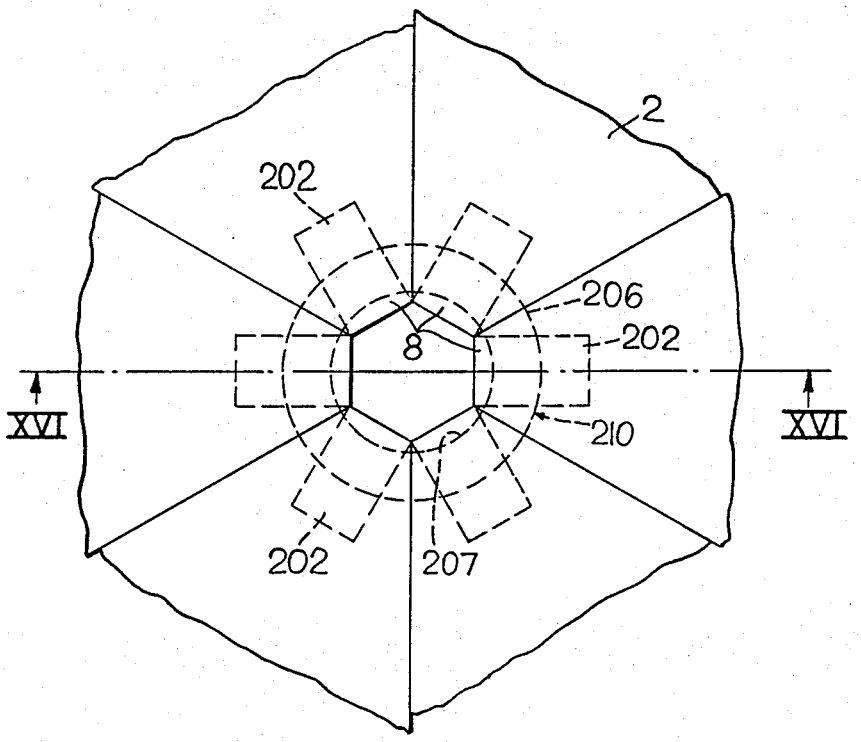
FIG. 15 is a partial plan view showing a modified form of a retainer means for securing the inner portions of the sections together.
Figure 16:
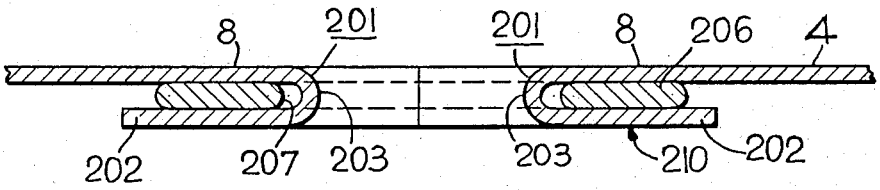
FIG. 16 is a sectional view taken along line XVI—XVI of FIG. 15.

The second means 210 for releasably securing the inner portions 8 together is best shown in FIGS. 15 and 16. The second means 210 includes a hook 201 mounted on each of the inner portions 8. The hook 201 includes a tab 202 and a bight portion 203 which connects the tabs 202 to the inner portion 8 to extend radially outward toward the side wall 6 in spaced parallel relation to the bottom wall 4. A hook receiving means in the form of a retainer ring 206 has an eye 207 for receiving each of the hooks 201. The diameter of eye 207 is greater than the radial length of tab 202. Preferably, the radial length of tab 202 is also shorter than the diameter of the hexagonal opening which exists when all tabs are inserted in ring 206 to facilitate insertion of the last tab during assembly. Each tab is inserted through the eye and then hooked under the ring 206 as the section 2 is moved radially outward. Preferably, the section 2 and associated tab 202 are made of a flexible material such as plastic to permit the tab to be slightly distorted to faciliate installation on the ring 207. The ring 206 need not be round. It could have a plurality of interior flat sides to match the number of sections and if the pool comprises six sections, the eye would be hexagonal in shape. The ring could also be provided with a plurality of individual openings, one for each hook. The ring 206 could also be formed from a flexible, long, slender strip of elastic or non-elastic material such as a rope or cable. Whatever form the ring 206 takes, it can, if desired, be permanently attached to one of the sections 2 so that it will not be lost when the nested sections are stored.

It is also within the scope of our invention to reverse the relationship of the hook and eye means. The hooks 201, instead of being on the inner portions 8, could be provided on the ring portion 206. With this reversal of parts, a hook receiving eye would be provided on the inner portion 8 of each section 2 and the hooks on the ring 206 would each be inserted in one of the eyes.

The bottom wall also includes a leading margin 12 and a trailing margin 14. The words "leading" and "trailing" as used in this description relate to the direction of movement of margins 12 and 14 of sections 2 as the swimming pool is being opened or closed, as illustrated by directional arrows 15 and 13 in FIG. 2 when the first retainer means 10 is used. The assembly and disassembly of the pool will be more fully described hereinafter.

The side wall 6 includes leading and trailing edges 16 and 18 which are generally vertical but their precise orientation will depend upon the angle selected for side wall 6 relative to bottom wall 4. A first releasable locking means 21 is provided on the leading edge 16 and a second releasable locking means 22 is provided on the trailing edge 18. The top edge 24 of side wall 6 terminates in a coping 26 having a 90° arc, when viewed in section. The bottom edge of side wall 6 gradually merges, over an arcuate transition area 27, into the outer edge region 28 of bottom wall 4. The transition area 27 can be sharp or graduated as desired. A drain opening 31 is provided adjacent the bottom of one section.

The releasable locking means 21, 22 (FIGS. 5 and 6) for interlocking the sections 2 will now be described. The first locking means 21 includes a first flange portion 33 that extends circumferentially away from the leading edge 16 of side wall 6 and a first latch portion 34 which folds back to extend circumferentially toward the leading edge 16 of side wall 6 in spaced parallel relation to the outer surface 36 of side wall 6 to form therebetween a first latch receiving gap 37. Similarly, the second locking means 22 comprises a second flange portion 43 extending circumferentially away from the trailing edge 18 of the side wall 6 and a second latch portion 44 which folds back to extend circumferentially toward the trailing edge 18 of side wall 6 in spaced parallel relation to the inner surface 46 to form therebetween a second latch receiving gap 47.

Figure 5:
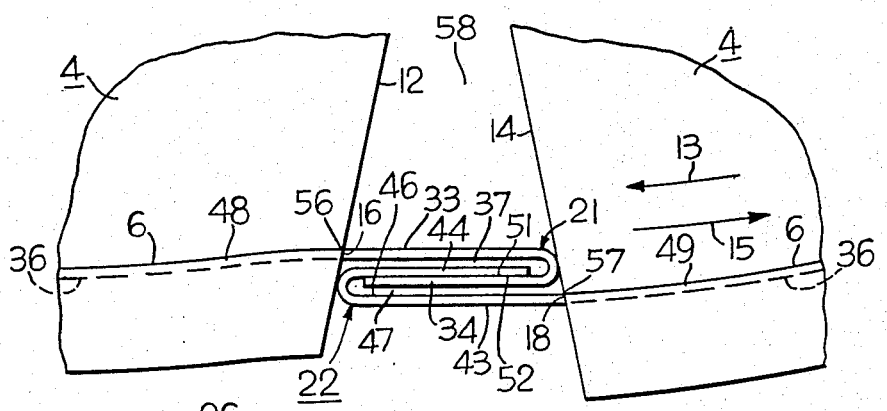
FIG. 5 is a top view of the locking means.
Figure 6:
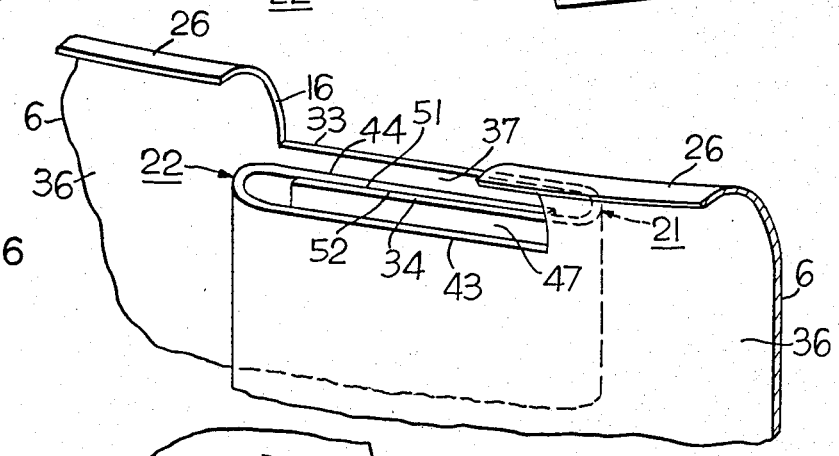
FIG. 6 is an isometric view of the locking means shown in FIG. 5.

As best appears in FIGS. 5 and 6, the area 48 of side wall 6 which borders the leading edge 16 is offset slightly in a radially inward direction. Similarly, the area 49 of side wall 6 which borders the trailing edge 18 is offset slightly but in a radially outward direction. The radially inner and outer offsets 48, 49 are dimensioned so that the inner surface 51 of first latch portion 34 and the inner surface 52 of second latch portion 44 will be in circumferential alignment with the outer surface 36 of side wall 6. In other words, the interface between surfaces 51 and 52 will be in the same circumferential plane as side wall 6.

In the embodiment as shown in FIGS. 3, 4, 5 and 6, the bottom wall 4 has leading and trailing margins 12, 14 which extend radially outward from the apex portion 8 and intersect the leading and trailing edges 16, 18 of side wall 6. In this embodiment, the flange portions 33 and 43 both extend circumferentially outward beyond the points of intersection 56, 57 of the leading and trailing margins 12, 14 with the vertical leading and trailing edges 16, 18 of the side wall 6. In this embodiment, a small wedge-shaped space 58 will exist between adjacent bottom walls 4 when the pool is set up. The space 58 has a functional significance during setup as will be explained hereinafter. A conventional vinyl plastic liner 59 (FIG. 11) is placed inside he pool after it is set up to make the pool cavity, defined by the sections 2, water tight. The upper edge of liner 59 is draped over coping 26 and secured by a detachable band 61 which surrounds the outer periphery of the pool when it is set up. The band 61 includes a hook and eye member for ease of attachment and detachment but other forms of attachment to secure the upper edge of the liner in place could be used.

Figures 3, 10, 12:
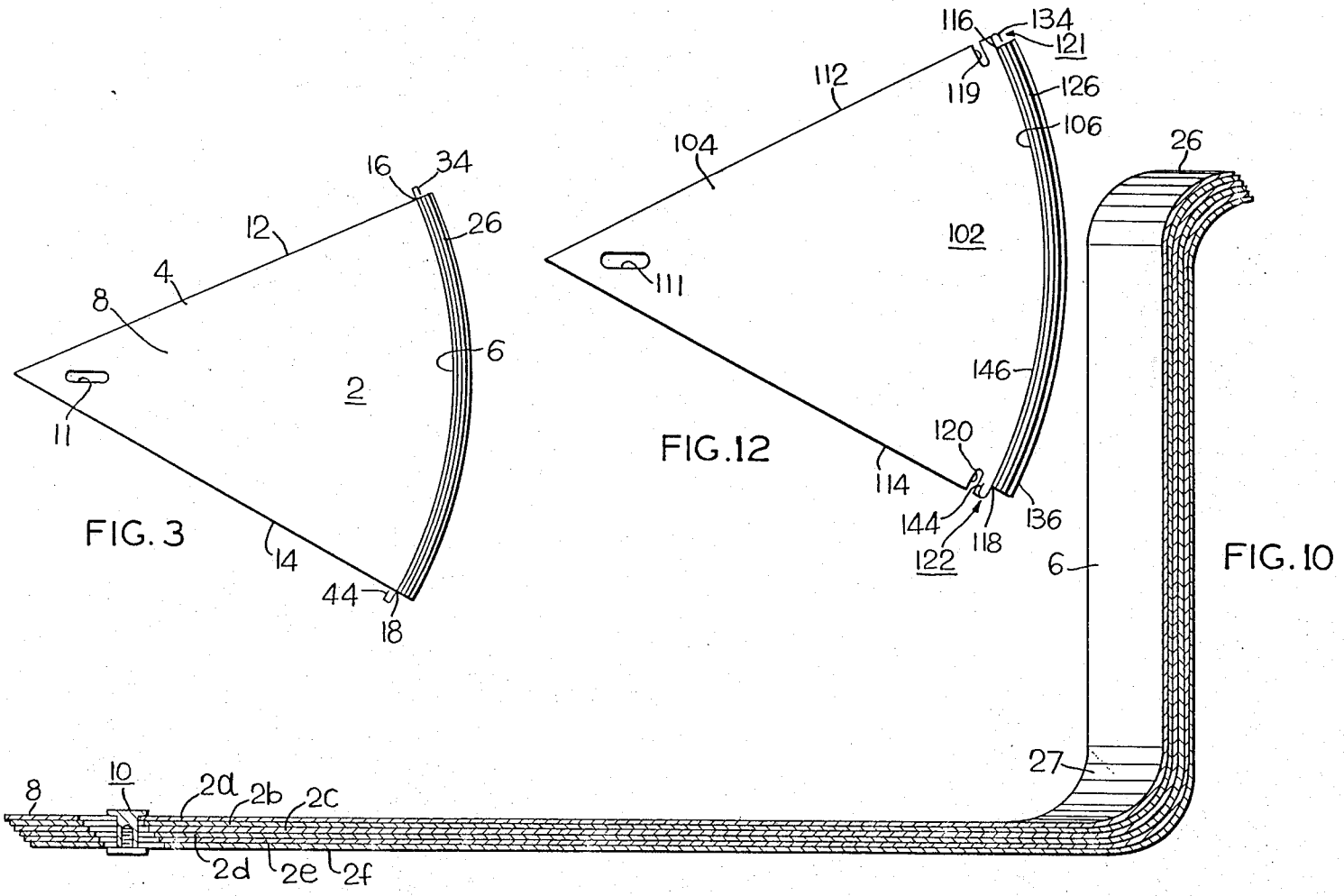
FIG. 3 is a top view of one of the sections that comprises the pool shown in FIG. 1.
FIG. 10 is a sectional view showing the sections which comprise the pool in a collapsed nested position relative to each other.
FIG. 12 is a top view of a second embodiment of the swimming pool section shown in FIGS. 3 and 4.
Figure 4:
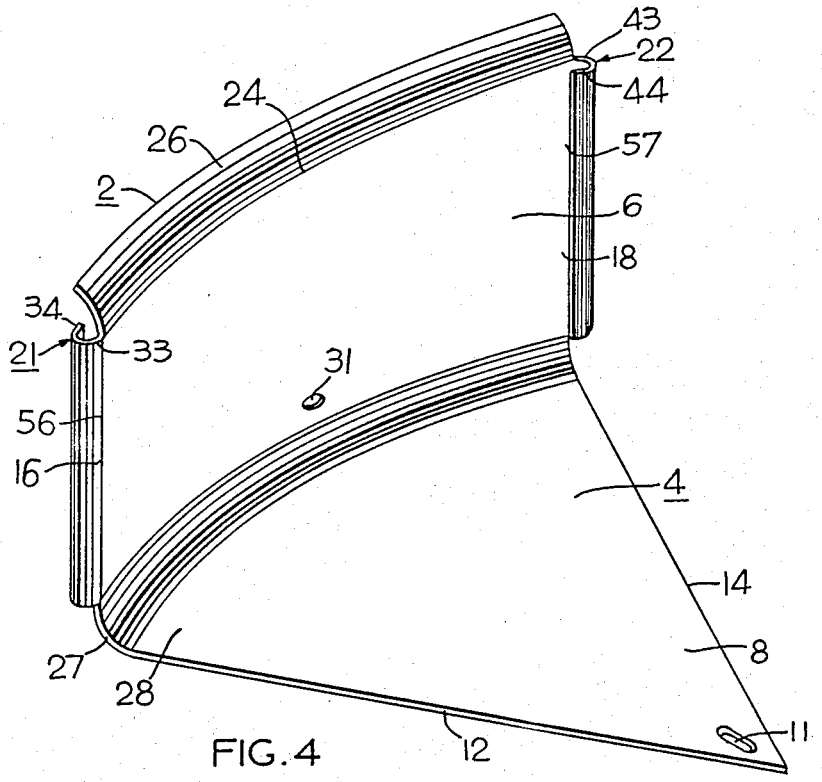
FIG. 4 is an isometric view of one of the sections.
Figure 11:
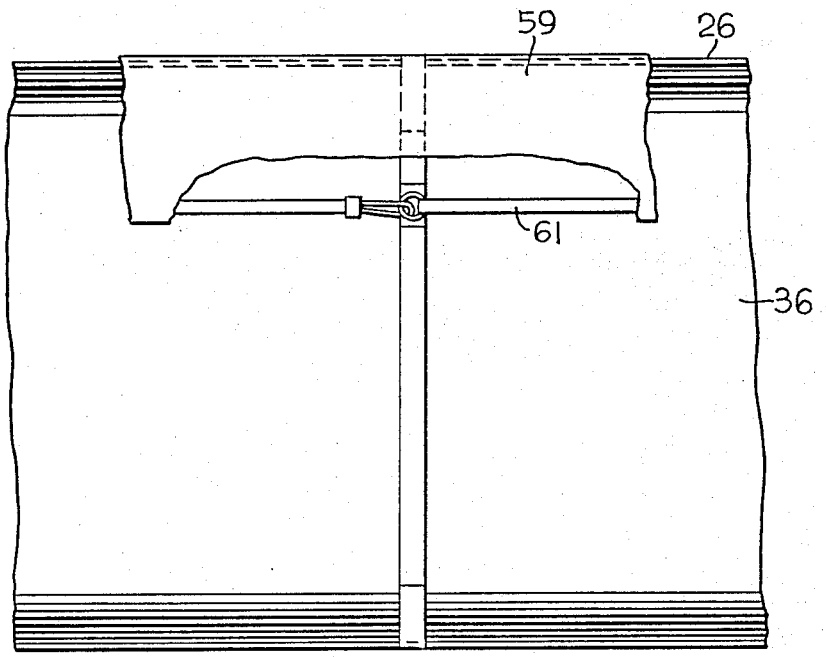
FIG. 11 is a partial side view of the pool shown in FIG. 1 showing the tensioning means for securing the pool liner in place.

To assemble the pool using the first retainer means 10, a plurality of sections which are identified as sections *2a*, *2b*, *2c*, *2d*, *2e*, and *2f* in FIG. 10 are nested one above the other to place the apex portions 8 in overlapping relation one on top of the other. As the sections 2 are all identical, the vertical nesting will orientate the lost motion apertures 11*a*, 11*b*, 11*c*, 11*d*, 11*e* and 11*f*, as shown in FIGS. 9 and 10, in general alignment with each other. As each aperture 11 has a longitudinal extent which is at least equal to the diameter of the pivot member 64 and the combined thickness of the total number of side walls 6, the apertures will define a pivot member receiving bore 63. The pivot member 64 is placed in the bore and has enlarged shoulder portions 66 which overlap the upper surface 67 of topmost section *2a* and the lower surface 68 of bottom section *2f* to loosely secure the apex portions 8 together to permit simultaneous radial and pivotal movements of each section 2 relative to the other sections. The pivot member 64 could be one unitary piece with the shoulder portions 66 permanently installed at the time of initial assembly but preferably the pivot member is constructed to be separated, as for example by providing a pair of threadably engageable elements as shown in FIG. 9, that can be readily disconnected to permit easy removal and replacement of any one of the sections should it become damaged. When the initial assembly is completed, the pool as shown in FIGS. 8, 9 and 10 is in a space saving, collapsed state for easy handling and storage.

FIGS. 1, 2, 5, 6 and 7 best show the pool in an open setup condition. To set up the pool, the section *2a* is maintained stationary and sections *2b*–*2f* are successively rotated fan-like about pivot member 64 in the direction of arrows 15 in FIG. 1. As each section 2 rotates to a fully open position, the second latch portion 44 on the trailing edge 18 slides into first gap 37 and the first latch portion 34 of first flange 33 on leading edge 16 slides into second gap 47 to interlock sections *2a* and *2b* together. Sections *2c*, *2d*, *2e* and *2f* are similarly successively rotated into fully open positions and their respective leading and trailing latch portions interlocked together as described above to complete the assembly. As each section 2 is rotated, it will slide radially outward until the radially inner end 76 of its respective lost motion aperture 11 abuts pivot member 64. Section *2b* is below section *2a* which places side wall 4 of section *2b* radially outward of the side wall 4 of section *2a*. Thus, when section *2b* is rotated in the direction of arrow 15, the second latch portion 44 will align with and naturally slide into first gap 37. Each succeeding section is located below the preceding section and is free to slide radially outward from pivot 64 so that the second latch portion 44 on the trailing edge 18 of each section will automatically align and slide into its associated gap 37. The leading edge 16 of the last section *2f* will not automatically align radially inside the trailing edge 18 of section *2a*. In addition, in order for first latch portion 34 to interlock into gap 47, the leading edge 16 of section *2f* must be pressed radially inward and circumferentially rotated far enough so that the second portion 34 moves completely past, that is, it bypasses the second latch portion 44 on the trailing edge 18 of section *2a*, at which position the leading edge 16 will become free to snap radially outward to align portion 34 with gap 47. The clearance gap or space 58, FIG. 5, and the semi-rigid flexible quality of the material from which the sections are made allows the bottom wall 4 of section *2f* to be flexed upward slightly while wall 6 is pressed radially inward to slightly distort the normal orientation of section *2f* to achieve the bypassing action as section *2f* is moved in the direction of arrow 15. The sections *2f* and *2a* are then counter-rotated in the direction of arrow 13 to move first latch portion 34 back into gap 47 and complete the setup of the pool. When all of the locking flanges 33, 43 are interlocked, the individual side walls are secured or united into an integrated circular side wall having sufficient tensil strength to resist the expansive radial and circumferential forces which will be experienced by the side wall when the pool liner is installed and filled with water.

A second embodiment of the pool section, identified by reference number 102, is shown in FIG. 12. Section 102 is similar in construction to that of section 2 and includes a bottom wall 104, a side wall 106, a lost motion aperture 111, coping 126, margins 112, 114 and outside and inside surfaces 136, 146.

Section 102 differs from section 2 in three aspects. First, while it is not apparent from the drawings, section 102 is constructed to have a slightly greater arcuate sector angle than that of section 2. The greater arcuate sector angle provides margins 112 and 114 that will overlap for their full radial extent and thus no gaps, such as gap 58, will exist between sections when the pool is set up. Second, a first slot 119 is provided in leading margin 112 and a second slot 120 is provided in trailing margin 114. The slots 119 and 120 are located adjacent where the margins 112 and 114 intersect the side wall leading and trailing edges 116, 118, respectively. The first and second slots 119, 120 extend circumferentially inwardly from the bottom wall margins 112, 114 toward each other. Preferably, the slots are arcuate but need not be. Third, the first locking means 121 includes a first latch portion 134 which is in spaced parallel relation to the outside surface 136 of side wall 106 and the second locking means 122 includes a second latch portion 144 which is in spaced parallel relation to the inside surface 146. The circumferential extent of the first and second latch portions 134 and 144 is no greater than the circumferential depth of the slots 119 and 120 and preferably the slots will be slightly deeper than the circumferential width of the latch portions 134, 144.

Figure 13:
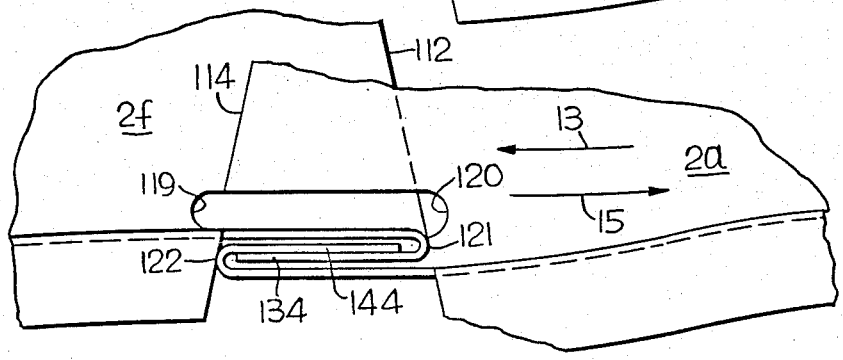
FIG. 13 is a top view corresponding to FIG. 5 showing the locking means of the second embodiment of FIG. 12.

A pool made up of sections 102 is assembled and is set up and collapsed in the same manner as a pool made of sections 2. With reference to FIG. 13, the presence of slots 119 and 120 permits the leading edge 121 of section *2f* to bypass inside of trailing edge 122 without any distortion of the bottom wall margin 114 which remains above adjacent margin 112 for its entire length. It will be appreciated that slots 119 and 120 need only be provided in the leading edge 112 of section *2a* and the trailing edge of section *2f* as there is only one intersection between adjacent sections where the vertical leading edge 121 must come through the floor 104 of an adjacent section. However, in order to reduce manufacturing costs and simplify assembly, it will be preferable to make all sections identical. Of course, it would be possible to use nonidentical sections and still utilize the basic concept of the invention.

Figure 14:
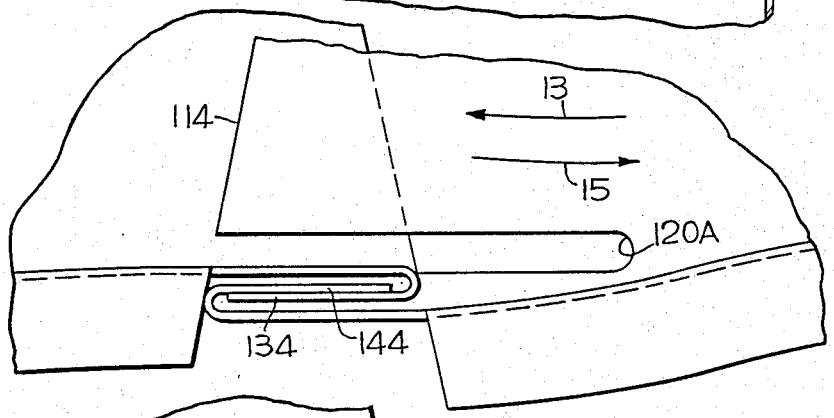
FIG. 14 is a top view corresponding to FIG. 5 showing the locking means of a third embodiment of the swimming pool section shown in FIGS. 3 and 4.

In the second embodiment of FIGS. 12 and 13, slots 119 and 120 are provided in both the leading and trailing edges 112 and 114. A third embodiment is shown in FIG. 14. With reference to FIG. 14, the slot 119 in the leading margin is eliminated and only one slot 120A is provided in trailing margin 114. If only one slot 120A is provided, it must have a circumferential extent which is at least equal to two times the circumferential width of latch portion 144 in order that latch portion 134 will bypass latch portion 144 a sufficient distance to permit the required interlocking action.

In the embodiments of FIGS. 12, 13 and 14, the use of slots 119, 120 and 120A will result in the leading margin 112 of one section overlapping the trailing margin 114 immediately below it so that there are no gaps between the bottom walls that form the floor. The setup and collapsing are performed in the same manner. Expanding or collapsing the pool sections 2 in a fan-like motion will only take a very short time and can be accomplished without the use of any tools or removal of any parts. Further, with a pool constructed according to the invention, there are no individual parts which can be mislaid or lost and a completely assembled swimming pool comprises only two major elements: (1) the interconnected assembly of sections 2, and (2) the liner.

To assemble a pool incorporating the second retainer means 210 shown in FIGS. 15 and 16, the tab 202 on the inner portion 8 of each section 2 is inserted through eye 207 of retainer ring 206. The section 2 is then moved radially outward until the tab is hooked over the ring 206. This procedure is repeated until all of the sections 2 are hooked into ring 206 in the side-by-side relationship shown in FIG. 15. When the retainer means 210 is used, the leading and trailing margins 12 and 14 of bottom walls 4 will abut each other and not overlap as is the case when the first retainer means 10 is used. The first and second releasable locking means 21, 22 are used to secure the leading and trailing edges 16, 18 of adjacent side walls 6 together as previously described with the flexibility of the sections providing the tolerance required to permit the interlocking. To disassemble, the releasable locking means is unhooked and the hooking procedure is reversed to unhook the tabs 202 from ring 206. When the sections 2 are all unhooked, they are nested for storage.

In the embodiments shown, the side walls 6 are arcuate when viewed from the top to provide a circular pool. The side walls could be straight to provide a hexagonal shaped pool. Also, sections of differing sizes could be used so that the pool would have another shape such as oval. If different sized or shaped sections are used, they would still nest but not as compactly as when identical sections are used.

What is claimed is:

1. A collapsible swimming pool structure for supporting a water retaining liner comprising a plurality of nestable sections each of which includes:

a bottom wall having an outer periphery, an inner portion, leading and trailing margins which extend radially outward from said inner portion to said outer periphery, and a lost motion aperture in said inner portion with said inner portions of said plurality of sections being in overlapping relation one on top of the other with said lost motion apertures aligned to define a pivot member receiving bore, said bottom walls forming a complete bottom wall for said swimming pool when it is set up;

a side wall connected to said outer periphery of said bottom wall and extending therefrom in a generally vertical direction, said side wall of each section cooperating with vertical side walls of adjacent sections to form a continuous side wall for the swimming pool when it is set up, said side wall having, generally vertical leading and trailing edges intersecting said bottom wall leading and trailing margins respectively, a first locking means including a first flange portion on said leading edge extending circumferentially outward beyond said intersection of said leading edge with said leading margin, a second locking means including a second flange portion on said trailing edge extending circumferentially outward beyond said intersection of said trailing edge with said trailing margin, said first locking means of one of said sections being secured to said second locking means of a side wall of an adjacent section when said swimming pool is in said setup position; and a retainer means for releasably securing said bottom wall inner portions together, said retainer means including a pivot member mounted in said bore to loosely secure said inner portions together to permit simultaneous radial and pivotal movements of each of said sections relative to the other of said sections, said movements allowing said sections to be rotated fan-like about said pivot member between a collapsed closed position in which said sections are nested one on top of the other for storage, and a setup open position in which said bottom walls coact one with another to form a circular swimming pool bottom and said side walls coact one with another to form a continuous circular side wall with said first locking means of each of said side wall sections releasably interlocked with said second locking means of an adjacent side wall section to secure said individual side walls into an integrated circular side wall.

2. A collapsible swimming pool according to claim 1 wherein said bottom wall of each of said sections includes:

leading and trailing margins which extend radially outward from said inner portion and intersect said side wall leading and trailing edges;

a first slot in said leading margin;

second slot in said trailing margin; and each of first and second slots being adjacent the point where said margins intersect said side wall leading and trailing edges with said first and second slots extending circumferentially inward from said bottom wall margins toward each other.

3. A collapsible swimming pool according to claim 2 wherein said side wall has an inside surface and an outside surface and wherein, said first locking means includes a first latch portion which is in spaced parallel relation to said side wall outside surface and extends parallel to said first slot for a distance which is no greater than the circumferential depth of said first slot, and said second locking means includes a second latch portion which is in spaced parallel relation to said side wall inside surface and extends parallel to said second slot for a distance which is no greater than the circumferential depth of said second slot.

4. A collapsible swimming pool according to claim 1 wherein said side wall has an inside surface and an outside surface and wherein, said first locking means first flange portion is in spaced parallel relation to said side wall outside surface, and said second locking means second flange portion is in spaced parallel relation to said side wall inside surface and extends parallel to said slot for a distance which is no greater than one-half of the circumferential depth of said slot.

5. A nestable section for use in cooperation with a plurality of such sections to form a collapsible swimming pool, said section comprising:

a bottom wall having an inner portion, said bottom wall being horizontally disposed when said section is set up in a position to form said pool;

a side wall connected to said bottom wall and having generally vertical leading and trailing edges when said section is set up in a position to form said pool;

a first locking means on said leading edge, a second locking means on said trailing edge, said first locking means being releasably interlockable with said second locking means of an adjacent section when a plurality of said sections are in said setup position to form a swimming pool;

said bottom wall further including a retainer means on said inner portion, leading and trailing margins which extend radially outward from said inner portion and intersect said side wall leading and trailing edges;

a first slot in said leading margin;

a second slot in said trailing margin; and each of said first and second slots being adjacent the point where said margins intersect said side wall leading and trailing edges with said first and second slots extending circumferentially inward of said bottom wall toward each other.

* * * * *